United States Patent [19]

Haas

[11] 4,295,579

[45] Oct. 20, 1981

[54] TABLET DISPENSER

[75] Inventor: Eduard Haas, Vienna, Austria

[73] Assignee: Centromint Company Establishment, Vaduz, Liechtenstein

[21] Appl. No.: 138,224

[22] Filed: Apr. 7, 1980

[30] Foreign Application Priority Data

Sep. 26, 1979 [AT] Austria ..... 6305/79

[51] Int. Cl.[3] ..... B65D 83/04; B65H 1/00; B65H 1/08; G07F 11/16

[52] U.S. Cl. ..... 221/229; 206/536; 221/197; 221/198; 221/247

[58] Field of Search ..... 206/536, 535; 221/229, 221/197, 198, 247, 230, 231, 232, 246

[56] References Cited

U.S. PATENT DOCUMENTS

| | | | |
|---|---|---|---|
| 2,620,061 | 12/1952 | Uxa | 221/229 |
| 2,853,206 | 9/1958 | Uxa | 221/229 |
| 3,410,455 | 11/1968 | Haas | 221/229 |
| 3,844,445 | 10/1974 | Haas | 221/229 |
| 4,171,753 | 10/1979 | Vreede | 206/536 |

FOREIGN PATENT DOCUMENTS

| | | | |
|---|---|---|---|
| 871685 | 6/1961 | United Kingdom | 221/229 |

*Primary Examiner*—William T. Dixson, Jr.
*Attorney, Agent, or Firm*—Kurt Kelman

[57] ABSTRACT

A tablet dispenser comprises a housing and a tablet storage receptacle coaxially displaceably mounted in the housing. The storage receptacle includes a spring biased to press a stack of tablets stored in the receptacle upwards towards a dispensing end of the receptacle. An end of the housing remains in contact with an end of the receptacle in an outer end position of the receptacle in relation to the housing. The housing has a relatively shallow groove terminating short of the contacting ends of the housing and receptacle, and the receptacle has a catch arranged close to the end of the receptacle contacting the end of the housing in the outer end position. A tolerance remains between the catch and the groove, and the catch has a height corresponding to the tolerance. A sloping transition or run-up section formed by an oblique portion extends between the catch and the groove adjacent the contacting ends.

5 Claims, 5 Drawing Figures

Fig. 2
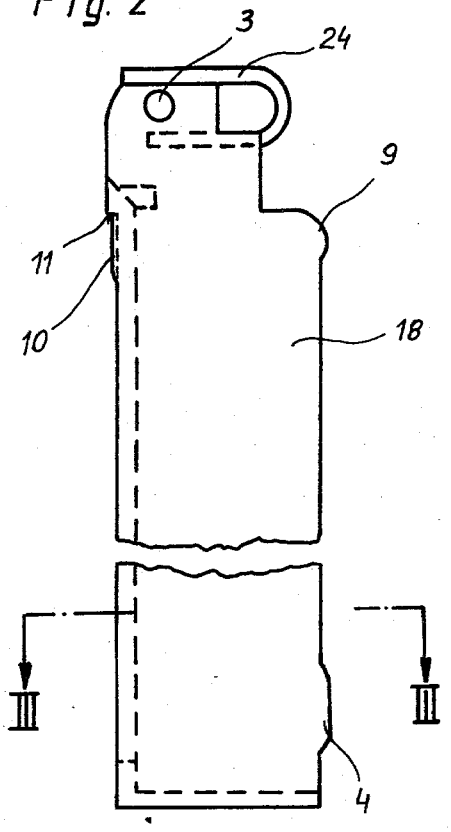
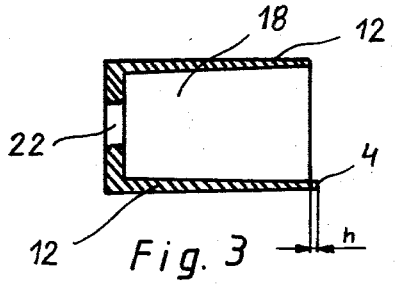
Fig. 3

TABLET DISPENSER

The present invention relates to improvements in a tablet dispenser comprising a housing part and a tablet storage receptacle part coaxially displaceably mounted in the housing part, the storage receptacle part including a spring biased to press a stack of tablets stored in the receptacle part upwards towards a dispensing end of the receptacle part.

Known tablet dispensers of this general type have the disadvantage that the tablet storage receptacle part must be held in an outer end position in relation to the housing part when the receptacle part is filled with a stack of tablets. Such dispensers are frequently used for storing candies in tablet form and for children, who constitute the major consumers of such candies, it may be quite difficult to hold the receptacle part in its outer end position while placing a stack of candies therein.

It is the primary object of this invention to overcome this disadvantage of conventional tablet dispensers.

The above and other objects are accomplished in accordance with the invention by providing the housing and receptacle parts of the tablet dispenser with respective contacting ends in the outer end position wherein the ends are in frictional engagement in this end position and prevent relative axial displacement of the parts. One of the parts provides a space defining a free play between the parts terminating short of the contacting ends and the other part has a catch arranged close to the end of the other part contacting the end of the one part in the outer end position. A tolerance remains between the catch and the space, and the catch has a height or width corresponding to the tolerance. A sloping run-up or transition section extends between the catch and the space adjacent the contacting ends.

In this manner, when the tablet storage receptacle part is axially displaced outwardly into the outer end position, the run-up section will gradually produce a frictional engagement between the two parts as the catch contacts the bottom of the space, thus preventing retraction of the receptacle part back into the housing part under the bias of the spring in the receptacle part. The receptacle part remains stationary in the extended outer end position to enable the receptacle part to be filled with a stack of tablets without the need for holding the receptacle part in the outer position. After the receptacle part is filled, it can be returned back into the housing part by a slight downward push to disengage the catch from its frictional engagement.

The above and other objects, advantages and features of the present invention will become more apparent from the following detailed description of a new preferred embodiment thereof, taken in conjunction with the accompanying drawing wherein FIG. 1 is an axial section showing a tablet dispenser according to this invention;

FIG. 2 is a side elevational view of a tablet storage receptacle part of the dispenser of FIG. 1;

FIG. 3 is a section along line III—III of FIG. 2;

Figure 1:
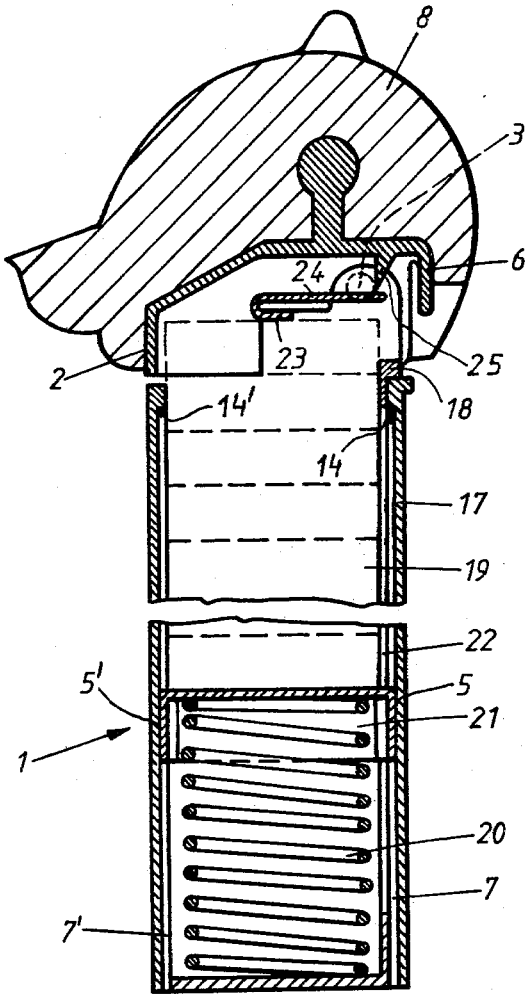

The general structure of tablet dispenser 1 is more or less conventional and comprises housing part 17 and tablet storage receptacle part 18 coaxially displaceably mounted in the housing part. The storage receptacle part includes coil spring 20 biased to press a stack of tablets 19, which are indicated in broken lines, upwards towards a dispensing end of receptacle part 18. In the illustrated embodiment, coil spring 20 is held between a fixed bottom and false bottom 21 of receptacle part 18 so as to bias the false bottom upwardly. The receptacle part (see FIG. 3) has two side walls 12 connected by a rear wall which defines longitudinal guide slot 22 while the front of the receptacle part is open to enable tablets 19 to be removed therefrom through the open front and a stack of tablets to be placed in the receptacle part. False bottom 21 has a rear extension passing through, and guided by, slot 22 while a front extension thereof passes through the open front of the receptacle part. The rear and front extensions of false bottom 21 have skirts 5 and 5', respectively, which engage, and are guided by, longitudinal grooves 7 and 7', respectively, during the axial displacement of receptacle part 18 in relation to housing part 17. The longitudinal grooves are defined in the rear and front walls, respectively, of the housing part and terminate short of the upper end of the housing part at shoulders 14 and 14' which project inwardly from the rear and front walls. The end shoulders 14, 14' of housing part 17 remain in contact with receptacle part 18 in an outer end position of the receptacle part in relation to the housing part.

As is generally known in tablet dispensers of this type, the two side walls 12 of receptacle part 18 have upwardly extending portions projecting beyond the upper end of housing part 17 and transversely extending pivot pin 3 is journaled in the upwardly extending side wall portions for pivotally supporting cover 2 on the receptacle part. At the top, the two upwardly extending side wall portions are connected by transverse bridge 23 which forms a stop for the stack of tablets 19, which is placed and held between false bottom 21 and bridge 23 in receptacle part 18. Bridge 23 is integral with leaf spring 24 extending rearwardly from the bridge and subtending pivot pin 3. Lug 25 projects downwardly from cover 2 into engagement with the free end of leaf spring 24. In this manner, the leaf spring biases the cover counter-clockwise into the illustrated closed position.

As appears clearly from FIG. 1, when the receptacle part is filled with a stack of tablets, uppermost tablet 19 rests against bridge 23 in a dispensing position above housing part 17 between the two upwardly extending side wall portions of receptacle part 18. Cover 2 carries handle portion 8 which may be operated by one finger of a hand, for instance the thumb, if desired, to pivot the cover clockwise about a transverse axis defined by pivot pin 3 to bring the cover into an open position exposing the uppermost tablet which rests in the dispensing position. The cover has skirt 6 at the rear thereof and, on pivoting cover 2 in the clockwise direction, the skirt passes between the two upwardly extending side wall portions of the receptacle part and engages the uppermost tablet to push it forwardly between the upper edge of housing part 17 and the lower edge of cover 2, enabling the tablet to be readily removed from dispenser 1. Upon releasing the finger from the handle, cover 2 will return automatically to its closed position under the bias of spring 24. Spring 20 will press false bottom 21 upwards to bring the succeeding tablet to rest at bridge 23. Obviously, pivot pin 3 may be stationary and cover 2 may have bores in its side walls wherein the pin is journaled to permit pivoting of the cover, or the pivot pin may be rotatably mounted in the upwardly extending side wall portions and the side walls of the cover may be affixed thereto to permit such pivoting, these pivoting structures being equivalent.

As shown in FIG. 2 the upper end of receptacle part 18 has a respective bulges 9 and 10 designed to cooperate with shoulders 14, 14' to provide a stabilizing engagement between the receptacle and housing parts when the receptacle part is fully extended into the housing part. This provides a stable connection between the two parts of tablet dispenser 1, further downward displacement of the receptacle part through the open bottom of the housing part being prevented by shoulder 11 on the receptacle part, which engages the upper rim of the housing part when the receptacle part is fully retracted into the housing part (see FIG. 1).

In a tablet dispenser of this type, the invention provides an arrangement which also holds the receptacle part stably in an extended outer position. According to this arrangement of the present invention, one of the parts of the dispenser, which is housing part 17 in the illustrated embodiment, has an end remaining in contact with the other part, which is receptacle part 18 in the illustrated embodiment, in an outer end position of the receptacle part in relation to the housing part. The one part provides a space defining a free play between the parts terminating short of the contacting end 14, 14', this space in the illustrated embodiment being relatively shallow groove 13 in housing part 17. The other part has catch 4 arranged close to an end of the other part contacting the end of the one part in the outer end position, the illustrated catch being a single protuberance 4 projecting from one of side walls 12 of receptacle part 18 and extending into groove 13.

Figure 5:
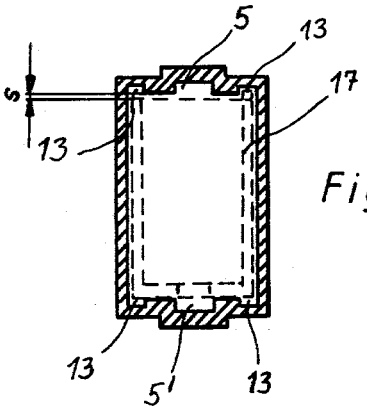
FIG. 5 is a transverse sectional view of the housing part, the receptacle part therein being indicated in broken lines.

As shown in FIG. 5, tolerance s remains between catch 4 and space 13. FIG. 3 shows that the catch has a height or width h corresponding to tolerance s.

Figure 4:
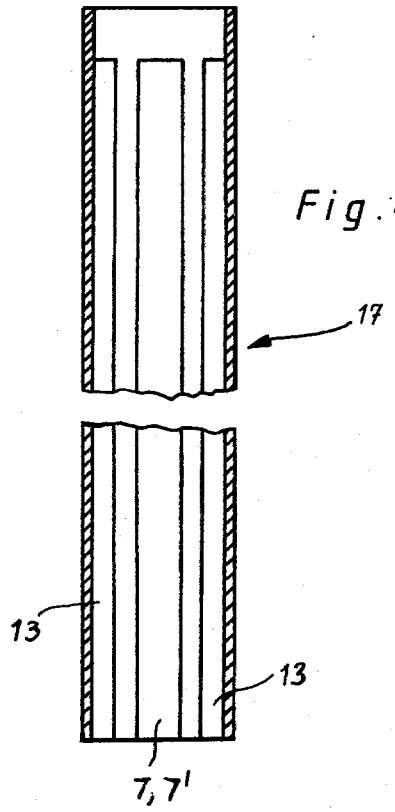
FIG. 4 is an axial section showing the housing part of the dispenser of FIG. 1.

A sloping transition or run-up section extends between the catch and the space adjacent the contacting ends, FIG. 2 illustrating the catch as having an obliquely extending portion forming the run-up section if desired, this transition section may be rounded or arcuate. Catch or protuberance 4 extends into groove 13 and glides therein freely until it runs up the outer end of the housing part to become wedged therein. As shown in FIG. 4, guide slots 7, 7' as well as longitudinal grooves 13, 13 terminate short of the upper end of the housing part. When receptacle part 18 is axially displaced outwardly, for instance by pressing against its bottom through the open bottom of the housing part, catch 4 will finally run up against the end of groove 13 wherein the catch is guided. Since tolerance s corresponds to height h of catch 4, the catch will be moved out of the groove on further upward displacement of the receptacle part and will be wedged against shoulder 14 at the upper end of the housing part. In this manner, a frictional engagement will be provided between the two parts of the dispenser and further displacement therebetween will be prevented. The receptacle part will be held in the extended outer position and will not be retracted into the housing part by spring 20.

In the illustrated embodiment, housing part 17 is of rectangular cross section (see FIG. 5). In this preferred embodiment, it is advantageous for the one part to define two grooves 13, 13 at respective corners of the one part and the other part to have a single catch 4 extending into one of the grooves. As shown in FIG. 5, the one part may define four such grooves at respective corners of the one part, the grooves being arranged symmetrically with respect to the axis of the dispenser parts. In this arrangement, it is possible to turn the two parts by 180° in relation to each other when they are put together, without interfering with the operation. In other words, no particular care need be taken when the two parts are put together since they will always fit.

While the space defining a free play between the dispenser parts has been described and illustrated as shallow groove 13 whereinto catch 4 extends, such a free play is not limited to this structural embodiment but could be provided also by the entire rear wall of housing part 17 being suitably spaced from the rear wall of receptacle part 18 to provide the free play, longitudinal grooves 7, 7' being defined in the rear wall of the housing part for guiding skirts 5, 5' of false bottom 21, which skirts would accordingly have to project farther outwardly to engage in the longitudinal guide grooves. Of course, the rear wall of the housing part would again have shoulder 14 to terminate the free play space short of the end of the housing part.

What is claimed is:

1. A tablet dispenser comprising a housing part and a tablet storage receptacle part coaxially displaceably mounted in the housing part, the storage receptacle part including a spring biased to press a stack of tablets stored in the receptacle part upwards towards a dispensing end of the receptacle part, one of the parts having an end remaining in contact with the other part in an outer end position of the receptacle part in relation to the housing part, the one part providing a space defining a free play between the parts terminating short of the contacting end, and the other part having a catch arranged close to an end of said other part contacting the end of the one part in the outer end position, a tolerance remaining between the catch and the space, and the catch having a height corresponding to the tolerance, a sloping run-up section extending between the catch and the space adjacent the contacting ends.

2. The tablet dispenser of claim 1, wherein the space defining the free play between the parts is a relatively shallow groove in the one part, the catch in the other part extending into the groove and having an obliquely extending transition portion forming the run-up section.

3. The tablet dispenser of claim 1 or 2, wherein the one part of the housing part and the other part is the storage receptacle part.

4. The tablet dispenser of claim 2, wherein the housing part is of rectangular cross section, the one part defining two of said grooves at respective corners of the one part and the other part having a single catch extending into one of the grooves.

5. The tablet dispenser of claim 4, wherein the end part defines four of said grooves at respective corners of the one part.

* * * * *